US005323793A

United States Patent [19]

Lorenzi

[11] Patent Number: 5,323,793

[45] Date of Patent: Jun. 28, 1994

[54] METHOD AND APPARATUS FOR STYLING HAIR

[76] Inventor: Paolo Lorenzi, 58 Main St., No. 2, Little Ferry, N.J. 07643

[21] Appl. No.: 985,625

[22] Filed: Dec. 3, 1992

[51] Int. Cl.[5] ..... A45D 8/12

[52] U.S. Cl. ..... 132/275; 132/145; 132/279; 15/185

[58] Field of Search ..... 132/120, 121, 144, 145, 132/146, 148, 156, 200, 275, 278, 279; 15/106, 185, 203

[56] References Cited

U.S. PATENT DOCUMENTS

| | | | |
|---|---|---|---|
| 673,098 | 4/1901 | Tissier | 132/279 |
| 989,656 | 4/1911 | Snow et al. | 132/279 |
| 1,174,531 | 3/1916 | Thornton | 132/278 |
| 1,741,073 | 12/1929 | Porter | 132/279 |
| 2,169,596 | 8/1939 | Solomon | 132/275 |
| 2,510,554 | 6/1950 | Christie | 132/146 |
| 2,577,098 | 12/1951 | Wood | 132/145 |
| 3,120,852 | 2/1964 | Sawyer | 132/156 |
| 4,057,867 | 11/1977 | Ballin | 15/185 |
| 4,116,205 | 9/1978 | Owen et al. | 132/313 |
| 4,467,491 | 8/1984 | Dekker | 15/185 |
| 4,494,269 | 1/1985 | Makabe | 15/203 |
| 4,507,818 | 4/1985 | Perdiz | 15/203 |
| 4,987,633 | 1/1985 | Heneveld | 15/185 |

FOREIGN PATENT DOCUMENTS

| | | | |
|---|---|---|---|
| 33012 | 6/1928 | France | 132/145 |
| 2651974 | 3/1991 | France | 132/279 |

OTHER PUBLICATIONS

Karina Spring/Summer 1993 Hair Ornament Collection Catalogue (56 pages) from Karina, 12 Van Vooren Drive Okland, NJ.

1993 Beauty Product Buying Guide (40 pages) from J & D Brush Company, Inc., 20 Central Avenue, Farmingdale, New York.

*Primary Examiner*—Gene Mancene
*Assistant Examiner*—Frank A. LaViola
*Attorney, Agent, or Firm*—Hopgood, Calimafde, Kalil, Blaustein & Judlowe

[57] ABSTRACT

Hair clasping and brushing device and method of styling hair using the same. The device is capable of being arranged in a brushing configuration for brushing hair and in a clasping configuration for clasping hair, and generally comprises a clasp frame, a brush assembly, a clasp bar, a hinge mechanism, and a releasable clasp locking mechanism. The clasp frame has a first clasp frame end portion, a second clasp frame end portion, and an intermediate clasp frame portion disposed therebetween. The brush assembly is disposed along the intermediate clasp frame portion, for brushing hair. The clasp bar has a first clasp bar end portion, a second clasp bar end portion, and an intermediate clasp bar portion disposed therebetween, which is capable of being grasped in the hand of a user. The hinge mechanism pivotally connects the first clasp frame end portion to the first clasp bar end portion so that the clasp bar can be selectively folded down over the clasp frame to provide the clamping configuration, or longitudinally extended with respect to the clasp frame to provide the brushing configuration. The clasp locking mechanism is provided for releasably locking together the second clasp frame end portion and the second clasp bar end portion when the clasp bar is folded over the clasp frame.

9 Claims, 7 Drawing Sheets

FIG. 8
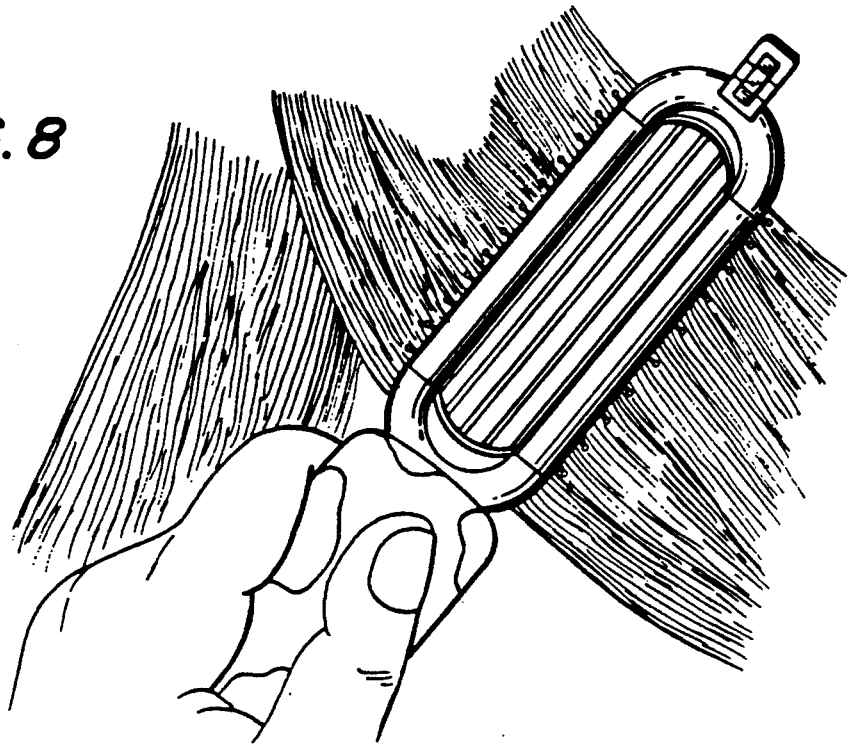
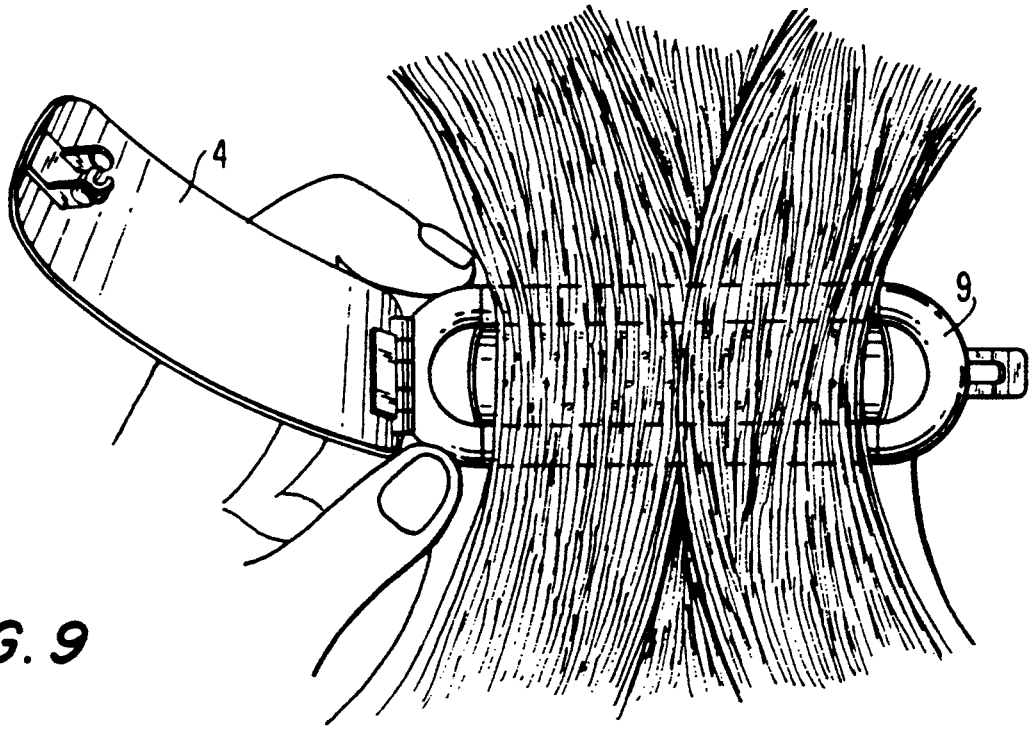
FIG. 9

METHOD AND APPARATUS FOR STYLING HAIR

BACKGROUND OF THE INVENTION

1. Field of Invention

The present invention relates to a single device which can be used for brushing and clasping hair, and also to a method of styling hair using such a device.

2. Brief Description of the Prior Art

Hair styling plays an important role in the social life of most men and women in our society. In general, the primary goal of hair styling is to render hair neat and attractive.

For women with longer length hair, a hair brush is often necessary to style and neaten their hair at various times during the day. Consequently, these women must carry a hair brush or comb in their pocketbooks, handbags or purses.

When women with longer length hair desire to hold their hair in place in a particular fashion, they often use a hair clip or bar, referred to as a "barrette". When these women style their hair, they must perform the following sequence of steps in a ritualistic manner. First, they must remove the barrette from their hair, place it aside, and retrieve a brush from their handbag or purse. They then use the brush to style their hair, retrieve the barrette, and use it to hold their hair in a selected fashion. As this procedure is time consuming and requires carrying a brush often in a purse or pocket, most women typically limit styling their hair to once or twice a day. Consequently, their hair does not look as neat and attractive as possible.

Hitherto, a wide variety of hair brushes and combs have been developed. In more recent times, fashion trends have been to carry smaller handbags, and thus there has been a corresponding demand for hair brushes which can be easily folded or collapsed for compact storage. An exemplary number of foldable hair brushes disclosed in U.S Pat. Nos. 4,987,633 to Heneveld; 4,507,818 to Perdiz; 4,494,269 to Makabe; 4,116,205 to Owen; and 4,057,868 to Latham. While the hair brushes disclosed in these U.S. Patents can be used to style hair and thereafter folded for compact storage, they have no other utility when folded and otherwise occupy the handbags, pocketbooks, and purses.

In an effort to provide a single device which can be used, to comb and clasp hair, U.S. Pat. No. 4,359,061 to Colclasure discloses a clasp member which can slidably move along the teeth of a comb in order to clasp hair therebetween. This prior art device, does not, however, provide a brush, is limited in terms of the amount of hair which can be clasped, and generally detracts from the appearance of its user.

Also, while hair clips having teeth elements are generally known in the art, none of these prior art devices can be used to brush and hold hair in a desired manner, while providing an aesthetically pleasing ornamental function.

Thus, there is a great need in the hair styling art for a single device which can be used to facilitate both hair brushing and clasping functions, without detracting from the appearance of the user.

OBJECTS AND SUMMARY OF PRESENT INVENTION

Accordingly, it is a primary object of the present invention to provide a novel device which can be configured into a hand-holdable brush for brushing hair and then reconfigured into a barrette for clasping hair.

A further object of the present invention is to provide such a device, in which the brush is completely concealed from view when the device is configured into a barrette.

A further object of the present invention is to provide such a device in which the clasp bar provides an ornamental function when the device is configured into a barrette.

A further object of the present invention is to provide a novel method for styling hair, in which the same device used to brush ones hair can be reconfigured to provide a barrette for holding the brushed hair in place.

These and other objects of the present invention will become apparent hereinafter.

BRIEF DESCRIPTION OF DRAWINGS

For a more complete understanding of the present invention, the Detailed Description of the Illustrative Embodiment hereof is to be taken in connection with the accompanying drawings, in which:

FIG. 8 is a perspective view of the device configured as shown in FIG. 7, shown being used to brush the hair of its user;

FIG. 9 is a perspective view of the device of the present invention being positioned with respect to a bunch of styled hair prior to being clipped in place;

DETAILED DESCRIPTION OF THE ILLUSTRATIVE EMBODIMENTS

Referring to FIGS. 1 through 11, the structure and function of the device of the present invention will be described.

Figure 1:
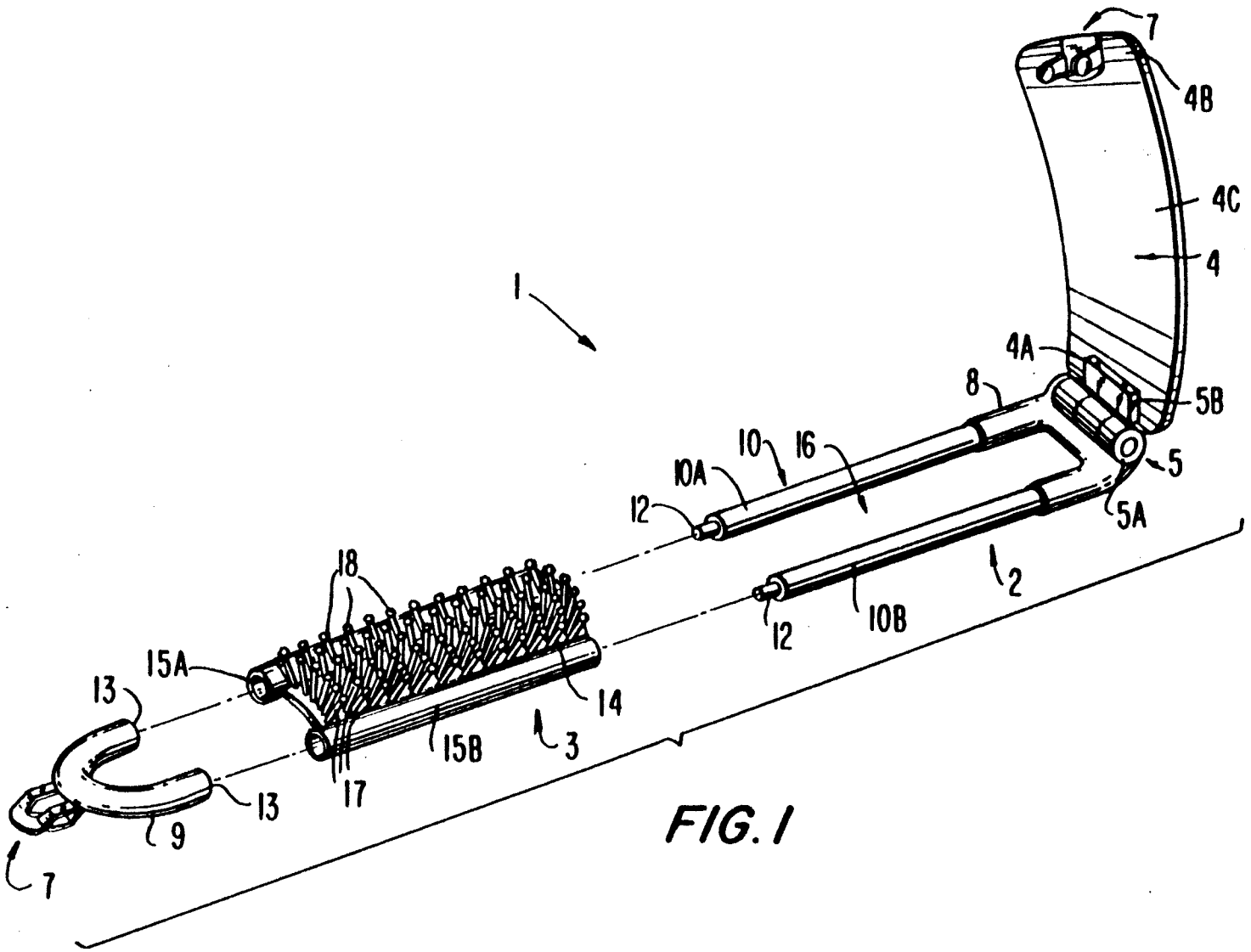
FIG. 1 is an exploded perspective view of the device of the present invention, showing the clasp bar pivotally connected to one end of the clasp frame, with the reconfigurable brush assembly removed from the clasp frame.

In general, hair clasping and brushing device 1 of the present invention comprises a clasp frame 2, a brush assembly 3, a clasp bar 4, hinge assembly 5, and releasable lock mechanism 7. As illustrated in FIG. 1, clasp frame 2 has first and second clasp frame end portions 8 and 9, and an intermediate clasp frame portion 10 disposed therebetween. Similarly, clasp bar 4 has first and second clasp bar end portions 4A and 4B and an intermediate clasp bar portion 4C therebetween. As shown in FIG. 1, intermediate clasp frame portion 10 comprises a pair of parallel spaced apart cylindrical support elements 10A and 10B, which extend from first clasp frame end portion 8. As shown, each cylindrical support element is terminated with a post 12, which is adapted for receipt into a socket 13 formed at the tip of second clasp frame end portion 9.

In the first illustrative embodiment shown in FIGS. 1 through 10, the clasp bar has a slightly arcuate, rectangular shaped configuration which encompasses an area greater than the area encompassed by the clasp frame. In alternative embodiments, however, it is understood that the shape and configuration of clasp bar 4 may differ from that shown herein without departing from the scope and spirit of the present invention.

Figure 4:
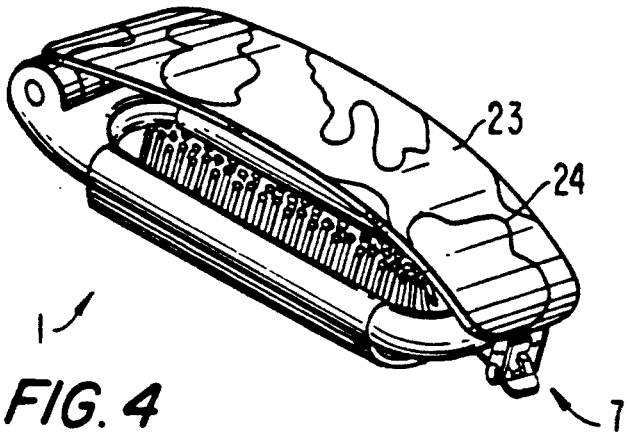
FIG. 4 is a perspective view of the device of the present invention showing the clasp bar folded down in an overlying relationship with respect to the clasp frame, with the brush assembly arranged in its retracted configuration and one end of the clasp bar releasably attached to one end of the clasp frame.
Figure 5:
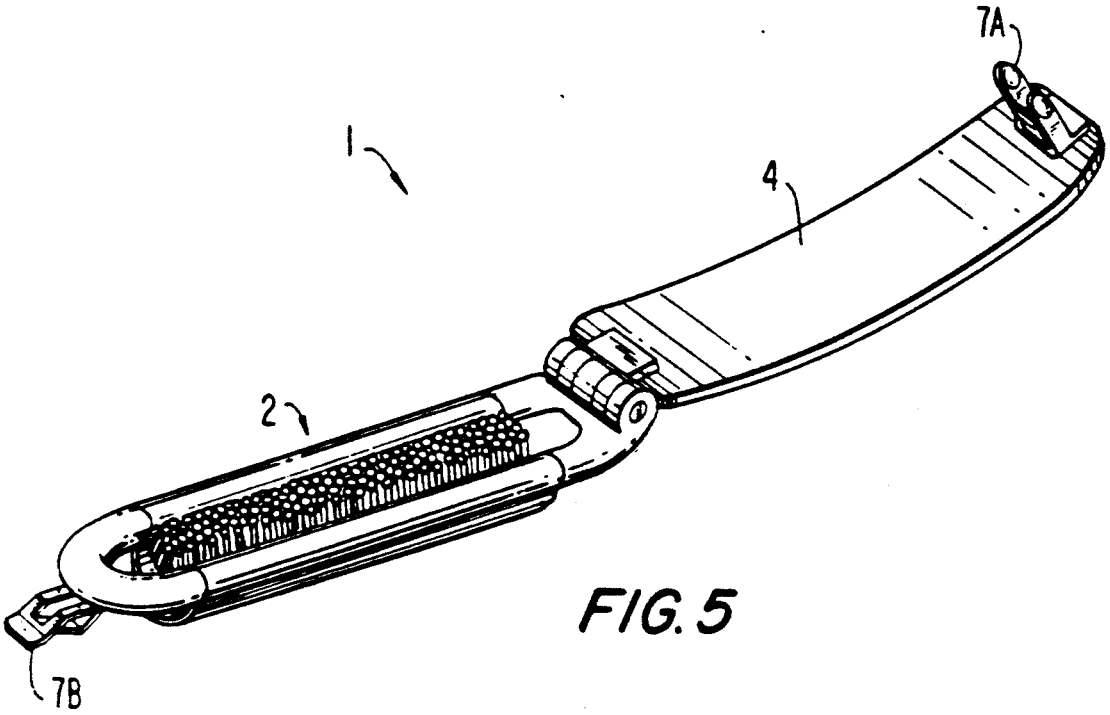
FIG. 5 is a perspective view of the device of the present invention, showing the clasp bar disposed along the longitudinal extent of the clasp frame, with the brush assembly arranged in its retracted configuration.

As shown, hinge assembly 6 comprises first and second hinge end portions 6A, and 6B, and an intermediate hinge portion 6C disposed therebetween. The first portion of hinge assembly 5 is joined to first clasp frame end portion 8, whereas the second portion of the hinge assembly is joined to first clasp bar end portion 4A. The function of hinge assembly 5 is to permit the clasp bar to be (i) folded down in an overlying relationship with respect to the clasp frame when the device is to be arranged into a clamping configuration, as shown in FIG. 4, and (ii) extended along the longitudinal direction of the clasp frame when the device is to be arranged in a brushing configuration, as shown in FIG. 5. Preferably, first clasp frame end portion 8 and first clasp bar end portion 4B are adapted to engage or contact each other when the clasp frame and clasp bar are longitudinally extended as shown in FIG. 5. This structural feature prevents the clasp frame and clasp bar from being disposed beyond an angle of 180 degrees. By providing for a sufficient amount of frictional engagement between the interconnected hinge end portions 5A and 5B, the clasp bar and clasp frame can be maintained in the brushing configuration shown in FIG. 5, without support or assistance from the user.

As illustrated in FIG. 1, brush assembly 3 comprises a flexible bristle support structure 14, preferably made from a pliant rubber. In its relaxed state, bristle support structure 14 has a planar extent of substantially rectangular dimensions. As shown, bristle support structure 14 has a pair of tubular support sleeves 15A and 15B formed along the longitudinally extending sides end portions of the structure. The inner diameter of tubular support sleeves 15A and 15B is slightly greater than the outer diameter of cylindrical support elements 10A and 10B. In this way, when bristle support structure 14 is deformed slightly into an arcuate configuration, as shown in FIG. 1, tubular support sleeves 15A and 15B can be slid over cylindrical support elements 10A and 10B, thereby suspending the flexible bristle support structure therebetween.

With the flexible bristle support structure suspended upon the cylindrical support elements of the clasp frame, posts 12 of cylindrical support elements 10A and 10B are joined with and permanently bonded to sockets 13 in second clasp frame end portion 9. As illustrated in FIG. 1, the assembly of the clasp frame elements forms an aperture region 16 in the clasp frame which is bounded by cylindrical support elements 10A and 10B, and first and second clasp frame end portions 8 and 9, respectively.

In the preferred embodiment of the present invention, the width dimension of flexible bristle support structure 14 is about 25% greater than the spacing between cylindrical support elements 10A and 10B. This feature of the brush assembly permits the flexible bristle support structure to be arranged into either of two possible stable configurations, namely; the retracted configuration illustrated in FIGS. 2, 3, 4, 5, 6, 9 and 10; or the protracted configuration illustrated in FIGS. 1, 7 and 8.

Figure 2:
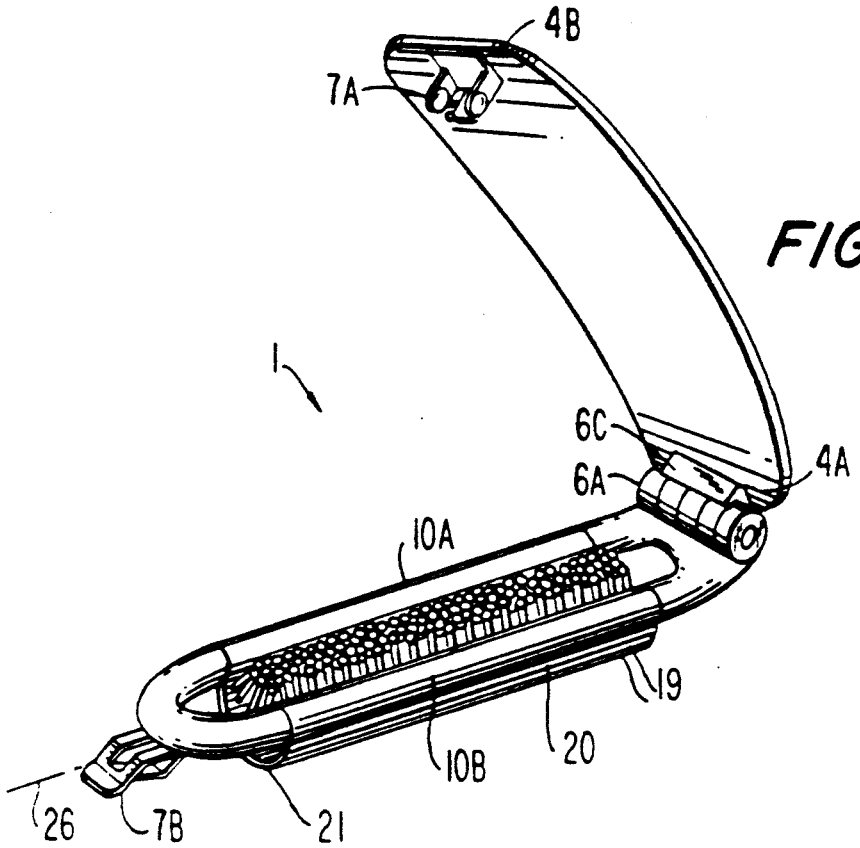
FIG. 2 is a perspective side view of the device of the present invention, showing the clasp bar disposed at an acute angle with respect to the clasp frame, and the brush assembly arranged in its retracted configuration.
Figure 7:
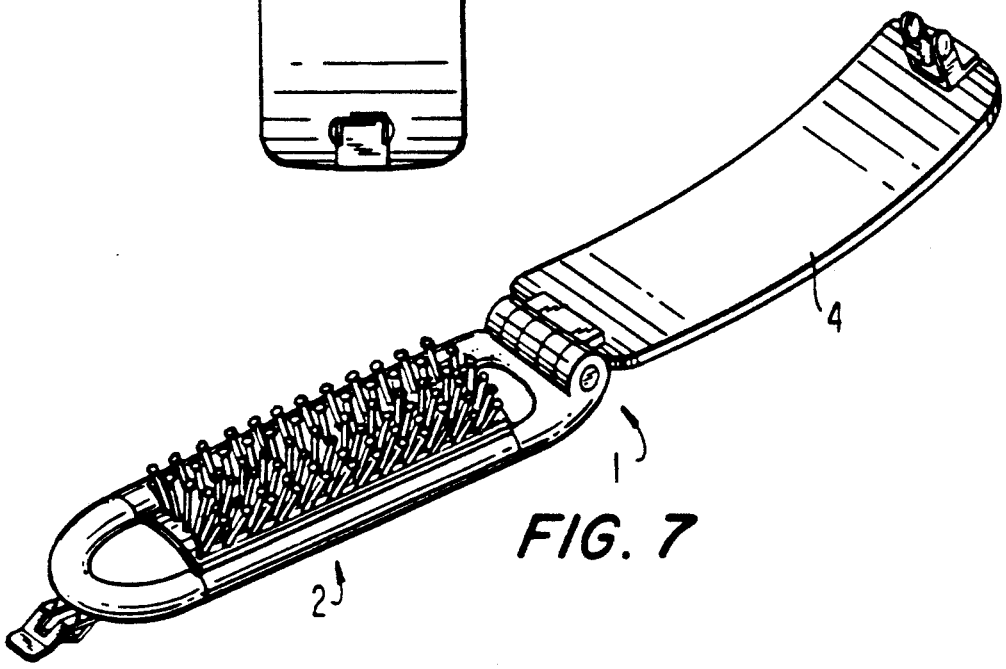
FIG. 7 is a perspective view of the device of the present invention, showing the clasp handle disposed along the longitudinal extent of the frame, with the brush assembly arranged in its protracted configuration, for use as a brush.

As most illustrated clearly in FIGS. 2 and 7, flexible bristle support structure 14 comprises a plurality of perforations 17 formed therein along a series of rows extending in a direction substantially parallel to the longitudinal extent of the frame. Through each row of perforations, a plurality of bristle elements 18 are passed so that the bristle elements (i) are outwardly directed (i.e. diverging) and the entire portion thereof disposed above aperture region 16 when the flexible bristle support structure is arranged into the protracted configuration, and (ii) are inwardly directed (i.e. converging) and a substantial portion thereof disposed below aperture region 16 when the flexible bristle support structure is arranged into the retracted configuration. As shown in FIG. 2, the plurality of bristle elements passing through each row of perforations, are interconnected at their proximal ends by a narrow base strip 19, which is snapped within a longitudinally extending recess 20 formed on the rear surface 21 of bristle support structure 14.

When the clasp bar is folded down in an overlying relationship with respect to the clasp frame, as shown in FIG. 4, second clasp bar end portion 4B is releasably attached to the second frame clasp end portion 9 by way of locking mechanism 7. Most clearly illustrated in FIGS. 2 and 3, locking mechanism 7 comprises a first attachment element 7A secured to second clasp bar end portion 4B, and a second attachment element 7B secured to second frame end portion 9. In the illustrative embodiment, first and second attachment elements 7A and 7B comprise are realized using a pair of spaced apart, finger-operated projections and a catch structure, respectively, which are commonly used in hair clips well known in the art. When the clasp bar is depressed in the direction of the clasp frame, the first and second attachment elements 7A and 7B automatically interlock and secure the clasp bar and clasp frame in the barrette configuration shown in FIG. 4. In order to release first and second attachment elements 7A and 7B, and thus the clasp bar from the clasp frame, a mechanical squeezing action is applied to the finger-operated projections of the first attachment element, which automatically releases the same from the catch structure of the second attachment element.

Figure 6:
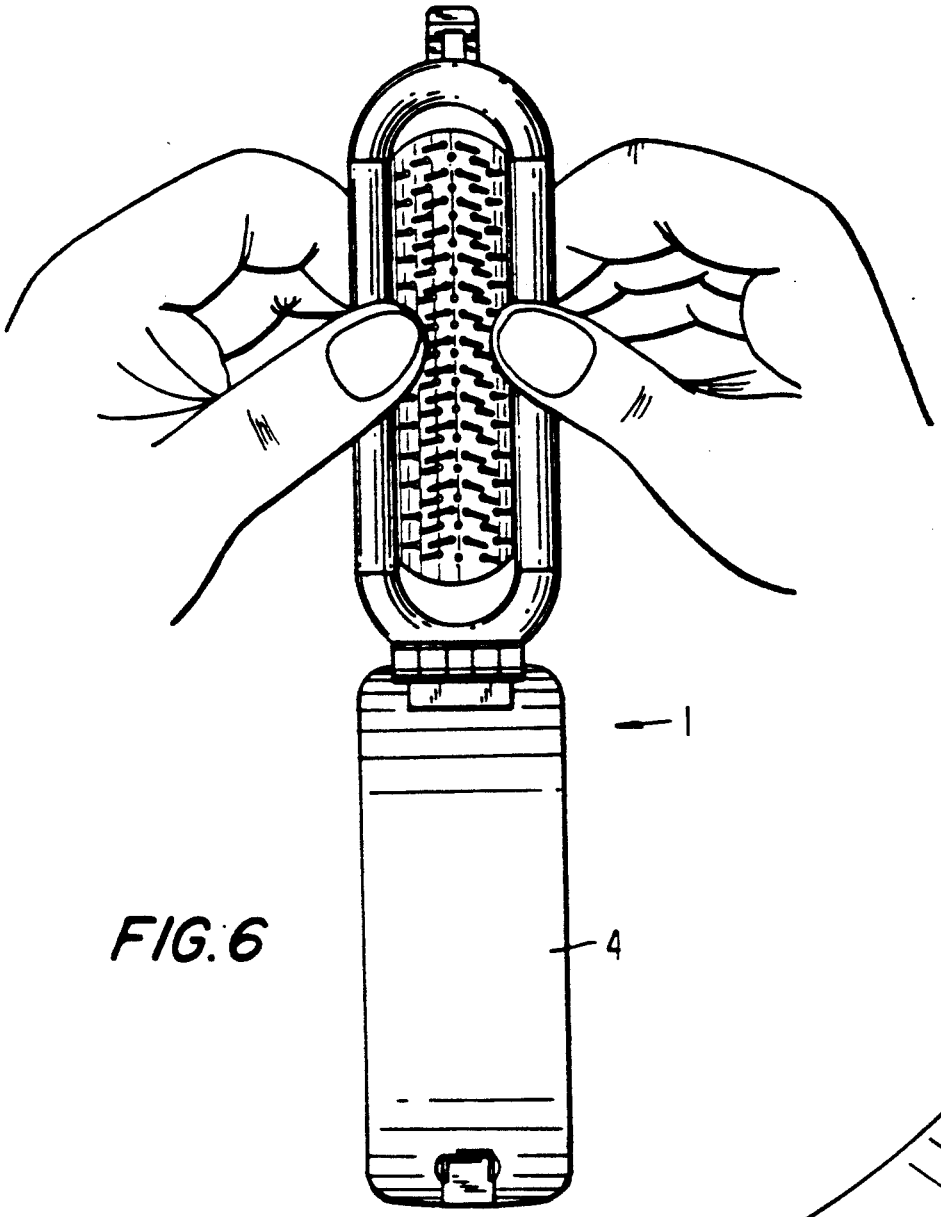
FIG. 6 is a plan view of the device of the present invention, showing the brush assembly being rearranged into its protracted configuration for use as a brush.

The device of the present invention can be arranged in two principally different configurations, namely): the brushing configuration of FIG. 7, and the hair clasping (i.e. barrette) configuration of FIG. 4. To arrange the device into the brushing configuration, the user simply pivots the clasp bar away from the clasp frame until the angle between the clasp bar and the clasp frame is approximately 180 degrees. Then, as illustrated in FIG. 6, the user places her left thumb on the central portion of tubular support sleeve 10B and her right thumb on the central portion of the tubular support sleeve 10A. Then with her remaining fingers placed on rear surface 21 of the brush assembly, flexible bristle support structure 14 is pushed through aperture region 16 of the clasp frame, until is rearranges itself into the stable brushing configuration shown in FIG. 7.

Figure 3:
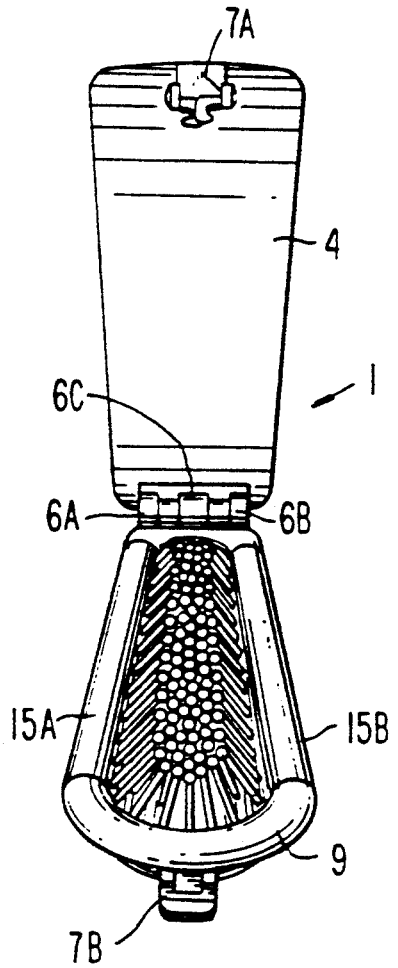
FIG. 3 is a perspective end view of the device of the present invention, showing the clasp bar disposed at an acute angle with respect to the clasp frame, and the brush assembly arranged in its retracted configuration.
Figure 10:
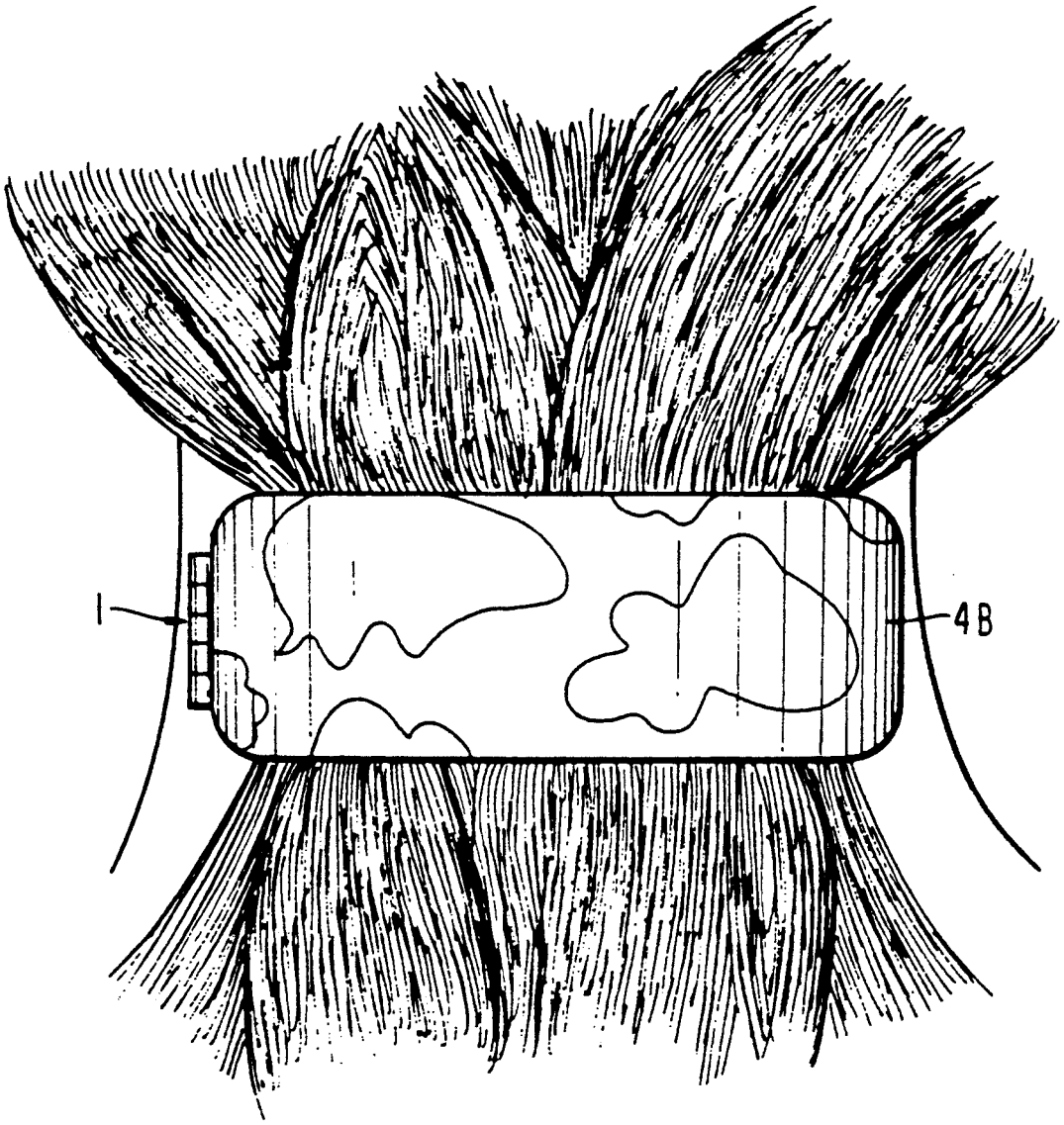
FIG. 10 is a perspective view of the device of the present invention, shown used as a barrette to clasp a bunch of groomed hair in place.

As illustrated in FIG. 8, the user can then use the configured device of FIG. 7 to style her hair as desired. When her hair is ready to be clasped in a desired fashion, the user then pushes flexible bristle support structure 14 back through aperture region 16, to rearrange the device into the clasping configuration illustrated in FIGS. 2, 3, and 4. Notably, in this configuration, the bristles converge substantially towards central axis 36 extending along the longitudinal extent of the clasp frame and protrude through and slightly above aperture region 16, as illustrated in FIGS. 2, 3, and 4, in particular. Then with the clasp bar and clasp frame of the reconfigured device disposed at an obtuse angle in the range of 90 to 180 degrees, the clasp frame is slid beneath styled hair 21, as illustrated in FIG. 7. Then by rotating the clasp bar down over the clasp frame, and pressing slightly therebetween, first attachment element 7A locks with second attachment element 7B. In this configuration, the converged bristles engage the strands of hair disposed between the clasp frame and clasp bar thereby firmly clasping the bundle of hair in place as desired, as illustrated in FIG. 10.

Whenever the user desires to style her hair, the following steps are simply performed. First, the clasp bar is unlocked from the clasp frame by gently squeezing first attachment element 7A as herein above described. The device is then removed from the user's hair and rearranged into the brushing configuration of FIG. 7. After hair brushing is completed, the device is rearranged into the clasping configuration to clasp the user's hair as desired.

In the illustrative embodiment, outer surface 23 of the clasp bar bears a decorative pattern 24. It is understood, however, that any other type of ornamentation may be provided to the clasp bar of the device. Examples of such ornamentation include real or costume jewels, incised and/or relieved carving, painted patterns, colored decals, or any suitable material which reflects, defracts and/or refracts light.

Figure 11:
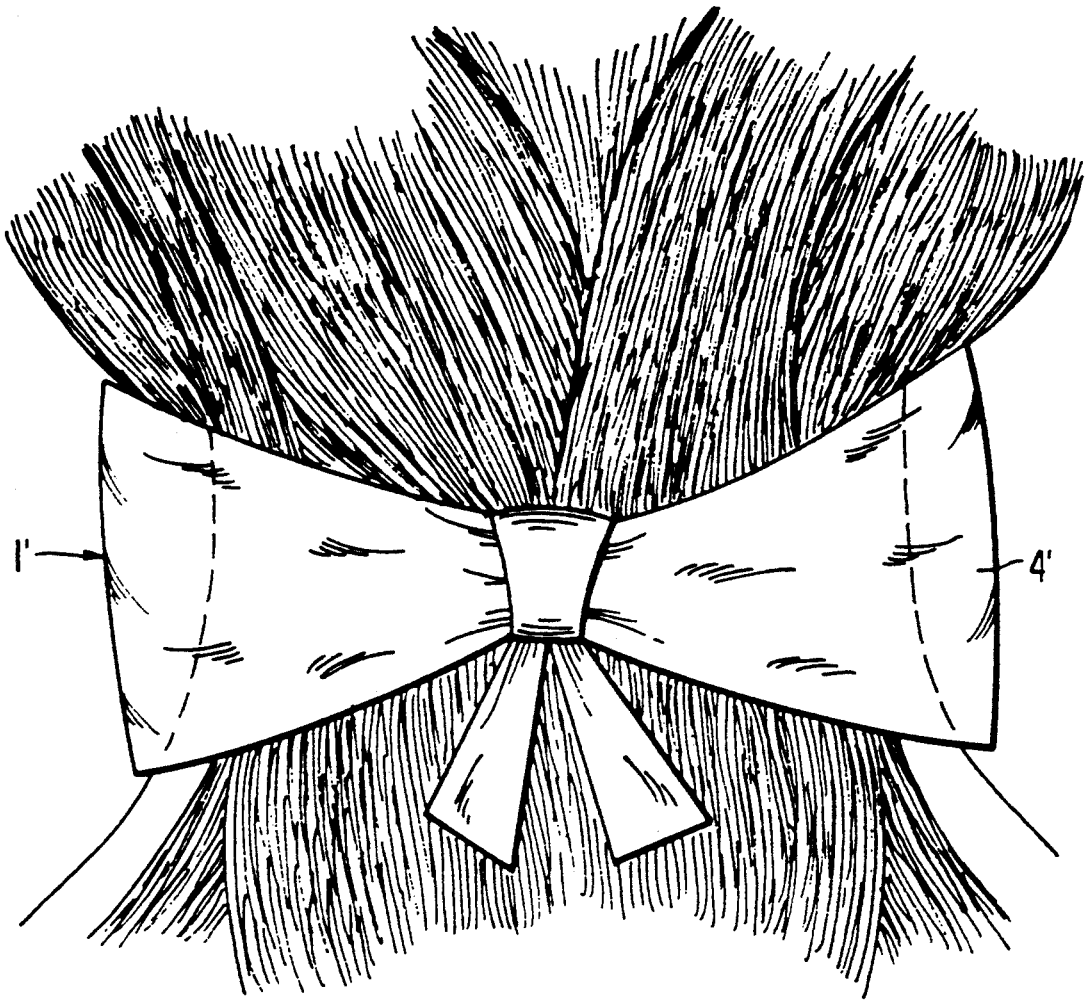
FIG. 11 is a perspective view of an alternative embodiment of the device of the present invention in which the clasp bar bears a bow.

As shown in FIG. 11, an alternative embodiment of the device of the present invention includes a fabric bow 25 affixed to the outer surface of clasp bar 4' using a suitable adhesive. In such an embodiment, the clasp bar will be substantially narrower than the clasp bar of the first embodiment described above. Together, the clasp bar and the bow function as a handle in the brushing configuration, so that the user can manually grasp the same during hair brushing operations shown in FIG. 8. After each brushing, the fabric of the bow can be "fluffed" by the user's fingers to easily reshape the bow prior to clipping the device to the user's hair.

While the preferred embodiment of the device and method of the present invention has been described in detail, it will be appreciated that numerous variations and modifications will occur to persons skilled in the art. All such variations and modifications shall constitute the present invention as defined by the scope and spirit of the appended claims.

What is claimed is:

1. A device capable of being arranged in a brushing configuration for brushing hair and in a clasping configuration for clasping hair, said device comprising:

a clasp frame having a first clasp frame end portion and a second clasp frame end portion, and an intermediate clasp frame portion disposed therebetween, said intermediate clasp frame including first and second elongated elements, each having a longitudinal extent and extending between said first and second clasp frame end portions so as to form an aperture region bounded by said first and second elongated elements and said first and second clasp frame end portions;

hair brushing means, disposed along said intermediate clasp frame portion, and including a flexible bristle support structure suspended between said first and second elongated elements and capable of being selectively arranged into a protracted configuration or a retracted configuration;

a plurality of bristle elements extending from said flexible bristle support structure such that said bristle elements converge and are disposed substantially beneath said aperture region when said flexible bristle support structure is arranged into said retracted configuration, and said bristle elements diverge and are disposed substantially above said aperture region when said flexible bristle support structure is arranged into said protracted configuration;

a clasp bar capable of being grasped in the hand of a user, and having a first clasp bar end portion and a second clasp bar end portion, and an intermediate clasp bar portion disposed therebetween;

hinge means for pivotally connecting said first clasp frame end portion to said first clasp bar end portion so that said clasp bar can be folded in an overlying relationship with respect to said clasp frame so as to provide said clamping configuration, or longitudinally extended with respect to said clasp frame so as to provide said brushing configuration; and locking means for releasably locking said clasp bar in a stationary relationship with respect to said clasp frame when said clasp bar is folded in said overlying relationship with respect to said clasp frame.

2. The device of claim 1, wherein said first elongated element comprises a first cylindrical structure, said second elongated element comprises a second cylindrical structure, and said first cylindrical structure is disposed substantially parallel to said second cylindrical structure.

3. The device of claim 1, wherein said locking means comprises a first attachment element joined to said second clasp frame end portion, and a second attachment element joined to said second clasp bar end portion, wherein said first and second attachment elements are releasably connectable when said clasp bar is folded in an overlying relationship with respect to said clasp frame.

4. The device of claim 1, wherein said clasp bar comprises an outer surface and an inner surface, said inner surface being adjacent said brush assembly when said clasp bar is folded in an overlying relationship with respect to said clasp frame, said device further comprising a bow affixed to said outer surface of said clasp bar.

5. A method of styling the hair of a user, comprising the steps of:

(a) providing a reconfigurable device capable of being arranged in a brushing configuration for brushing hair and in a clasping configuration for clasping hair, said reconfigurable device including:

a clasp frame having a first clasp frame end portion and a second clasp frame end portion, and an intermediate clasp frame portion disposed therebetween, brush means, disposed along said intermediate clasp frame portion, for brushing hair, a clasp bar, having a first clasp bar end portion and a second clasp bar end portion, and an intermediate clasp bar portion disposed therebetween and capable of being grasped in the hand of a user having hair, a hinge means for pivotally connecting said first clasp frame end portion to said first clasp bar end portion so that said clasp bar can be folded in an overlying relationship with respect to said clasp frame to provide said clasping configuration, or longitudinally extended with respect to said clasp frame so as to provide said brushing configuration, and locking means for releasably locking said clasp bar substantially stationary with respect to said clasp frame when said clasp bar is folded in said overlying relationship with respect to said clasp frame;

(b) arranging said device so as to provide said brushing configuration;

(c) brushing the hair of said user;

(d) rearranging said device so as to provide said clasping configuration, and clasping said brushed hair in a desired fashion between said clasp frame and said clasp bar; and (e) releasably locking said clasp bar with respect to said clasp frame, whereby the hair of said user is styled.

6. A reconfigurable hair styling device capable of being selectively configured in a brushing configuration for brushing hair and in a clasping configuration for clasping hair, comprising:

a clasp frame having a first clasp frame end portion, a second clasp frame end portion, and an intermediate clasp frame portion disposed therebetween, said intermediate clasp frame portion further including first and second elongated elements, each extending between said first and second clasp frame end portions so as to form an aperture region bounded by said first and second elongated elements and said first and second clasp frame end portions;

hair brushing means, disposed along said intermediate clasp frame portion, and including a flexible bristle support structure suspended between said first and second elongated elements and capable of being selectively configured into a protracted configuration or a retracted configuration, and a plurality of bristle elements, each said bristle element having a tip portion and extending from said flexible bristle support structure;

a clasp bar having a first clasp bar end portion and a second clasp bar end portion, and an intermediate clasp bar portion disposed therebetween, said clasp bar being graspable in the hand of a user;

hinge means for pivotally connecting said first clasp frame end portion to said first clasp bar end portion so that said clasp bar can be selectively (i) folded in an overlying relationship with respect to said clasp frame so as to provide said clasping configuration, or (ii) longitudinally extended with respect to said clasp frame so as to provide said brushing configuration; and locking means for releasably locking said clasp bar in a stationary relationship with respect to said clasp frame whenever said flexible bristle support structure is configured in said retracted configuration and said clasp bar is folded in said overlying relationship with respect to said clasp frame, whereby said hair is claspable between said intermediate clasp frame portion of said clasp frame and said intermediate clasp bar portion of said clasp bar whenever said flexible bristle support structure is configured in said retracted configuration, said clasp bar is closed in an overlying relationship with respect to said clasp frame and said locking means locks said clasp bar in a substantially stationary relationship with respect to said clasp frame.

7. The reconfigurable hair styling device of claim 6, wherein said locking means comprises a first attachment element joined to said second clasp frame end portion, and a second attachment element joined to said second clasp bar end portion, wherein said first and second attachment elements are releasably fastenable when said clasp bar is folded in an overlying relationship with respect to said clasp frame.

8. The reconfigurable hair styling device of claim 6, wherein said clasp bar comprises an outer surface and an inner surface, said inner surface being adjacent said brush means when said clasp bar is folded in an overlying relationship with respect to said clasp frame, and said reconfigurable hair styling device further comprising an ornament affixed to said outer surface of said clasp bar.

9. The reconfigurable hair styling device of claim 8, wherein said ornament is a bow.

* * * * *